United States Patent [19]

Hojbjerg

[11] 4,313,690

[45] Feb. 2, 1982

[54] ASPHALT LAYING MACHINE

[75] Inventor: Svend Hojbjerg, Vejen, Denmark

[73] Assignee: AS Phonix, Vejen, Denmark

[21] Appl. No.: 110,488

[22] Filed: Jan. 8, 1980

[30] Foreign Application Priority Data

| | | | |
|---|---|---|---|
| Dec. 14, 1977 | [DK] | Denmark | 5562/77 |
| Dec. 11, 1978 | [GB] | United Kingdom | 47918/78 |
| Dec. 12, 1978 | [DE] | Fed. Rep. of Germany | 2853601 |
| Dec. 14, 1978 | [NL] | Netherlands | 7812175 |
| Dec. 14, 1978 | [SE] | Sweden | 7812878 |

[51] Int. Cl.[3] ..... E01C 19/38

[52] U.S. Cl. ..... 404/114

[58] Field of Search ..... 404/114, 104, 106, 108, 404/119

[56] References Cited

U.S. PATENT DOCUMENTS

| | | | |
|---|---|---|---|
| 2,018,294 | 10/1935 | Baily | 404/114 |
| 2,976,784 | 3/1961 | Perkins et al. | 404/119 |
| 3,336,848 | 8/1967 | Moir | 404/114 |
| 3,817,644 | 6/1974 | Matson | 404/114 |
| 3,838,933 | 10/1974 | Lehman et al. | 404/114 |
| 3,841,777 | 10/1974 | Domenighetti | 404/114 X |

FOREIGN PATENT DOCUMENTS

| | | | |
|---|---|---|---|
| 1534216 | 2/1969 | Fed. Rep. of Germany | 404/114 |
| 2448665 | 4/1976 | Fed. Rep. of Germany | 404/106 |
| 2727932 | 7/1978 | Fed. Rep. of Germany | 404/104 |
| 2024900 | 1/1980 | United Kingdom | 404/104 |

*Primary Examiner*—Rodney H. Bonck

*Attorney, Agent, or Firm*—Scully, Scott, Murphy & Presser

[57] ABSTRACT

An asphalt laying machine having a vibrating smoothing and compacting unit, called screed assembly, and being of the type, which has a main screed with a plurality of laterally slidable extensions. In known machines said units are rigidly interconnected and their dimensions are so large that stationary vibrations may be produced in the smoothing and compacting unit, resulting in a non-homogenous asphalt course. According to the invention the smoothing and compacting unit (5) is divided into a plurality of units (12,13) having respective vibration generating means (24) and being mutually vibration isolated by means of vibration dampers (17A, 17B) ensuring a controlled, vibratory movement. The swing of each unit at the front edge preferably differs from the swing at the rear edge.

4 Claims, 4 Drawing Figures

ASPHALT LAYING MACHINE

Figure 1:
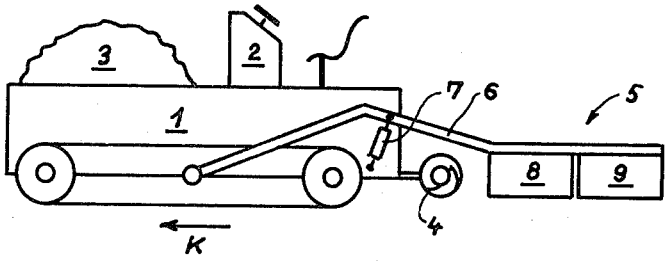

The invention relates to an asphalt laying machine having a vibrating smoothing and compacting unit usually designated as the screed assembly of the machine. Said screed assembly is adapted to compact and smooth the asphalt course to be layed by means of the machine, the forward portion of the screed assembly being provided with means for distributing asphalt material levelled by means of a scraper plate before the asphalt material is compacted and smoothed by the screed plate.

The prior art includes screed assemblies having a relatively slowly moving tamper which is positioned on the forward portion thereof and which is caused to move in a plane perpendicular to the longitudinaldirection of the asphalt course.

The prior art also comprises screed assemblies where the screed plate is caused to vibrate rapidly in a circular motion in a vertical plane and finally there are screed assemblies comprising a combination of said compacting and smoothing units. The invention relates to the type of screed assemblies in which the vibrating movements are exclusively brought about by rotating means.

It has become common practice to allow for lateral extension of the screed assembly of asphalt laying machines of the subject type so that the asphalt course laid may have an increased width. However, this gives rise to a problem because the prior art machines are constructed as a rigid unit, so that non-synchronism between several rotating means may entail stationary vibrations in the wide screed assembly which then vibrates to an optimum degree at some points and does not vibrate at all at other points. This results in an undesirable lack of homogeneity in the asphalt course.

The object of the invention is to provide an asphalt laying machine permitting a uniformly compacted and smoothed asphalt course.

Accordingly, the invention provides an asphalt laying machine with a compacting unit comprising a main section with vibration generating means, and comprising one or more additional sections for expanding the working range of the compacting unit, wherein each add that each additional section is suspended in a vibration isolated manner from a common carrier means by associated vibration dampers and is provided with associated vibration generating means. Said structure prevents stationary vibrations in the screed assembly.

A preferred embodiment of the machine wherein the common carrier means comprises two carrier frames which are slidable on opposite sides of the center of the machine and arranged to carry an additional section each, is characterized in that the main section and said additional sections are separately connected to the common carrier means exclusively by the respective vibration dampers. This structure in particular, in which the laterally slidable, additional sections are mounted behind the main section so that the extent of the compacting unit in the longitudinal direction of the machine is relatively great, involved a great risk of said stationary vibrations which according to the invention are obviated because the sections are mutually vibration isolated.

Preferably, the forward portion of a compacting section, seen in relation to the asphalt laying direction of the machine, is connected to the common carrier means by vibration dampers permitting vibration of the associated section in a plane normal to the front edge, and the rear portion of said compacting section is connected to the common carrier means by other vibration dampers permitting horizontal movements in the longitudinal direction of the machine, the front and rear vibration dampers being of the same type, where a shaft is secured to the associated section in parallel with the front edge thereof and extends through an elastic sleeve in a bushing attached to the common carrier means, the rear sleeves preferably being less yieldable than the front sleeves, the respective shafts of the rear vibration dampers being connected to the section via an arm pivotable around the associated shaft. Hereby it is achieved that the amplitude of the vertical vibrations is greatest at the front edge of a section, while the amplitude of the vertical vibrations is lower at the rear edge of the section where the asphalt material is compacted.

The uniformity of the asphalt course may be further improved by dividing a scraper plate at the front edge of the compacting unit, into sections and securing each of said sections to an associated compacting section for vibration therewith. Said scraper plate in connection with said vibration functions both as a leveller of the asphalt material and as a plough setting the asphalt material in rotation, which ensures that it is not the same material that constantly accumulates before the scraper plate. Thus, the asphalt course becomes more uniform partly because the asphalt material laid out will have a uniform temperature, and partly because the movement of the individual scraper plate sections is well-defined without any risk of nodes as the sections are mutually vibration isolated.

The even distribution of the asphalt material may be further improved before it is compacted and smoothed by giving the scraper plates a concave configuration and directing the vibratory movements so that each section moves forward in the direction of travel of the machine when the section is near its lowermost position, and also by providing the scraper plates with a plurality of inclined guide plates sloping away from the front edge of the associated section and towards the nearest outer side of the machine.

Figure 2:
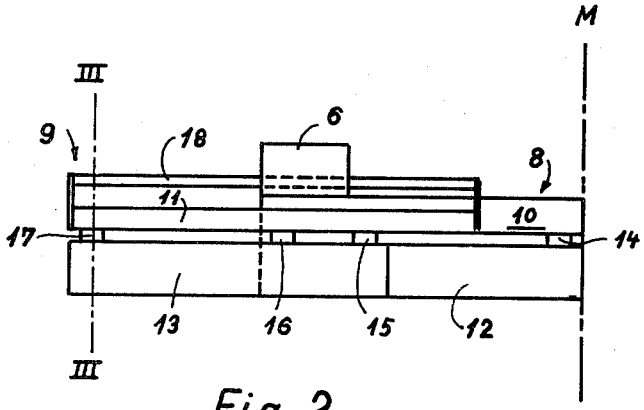
Figure 3:
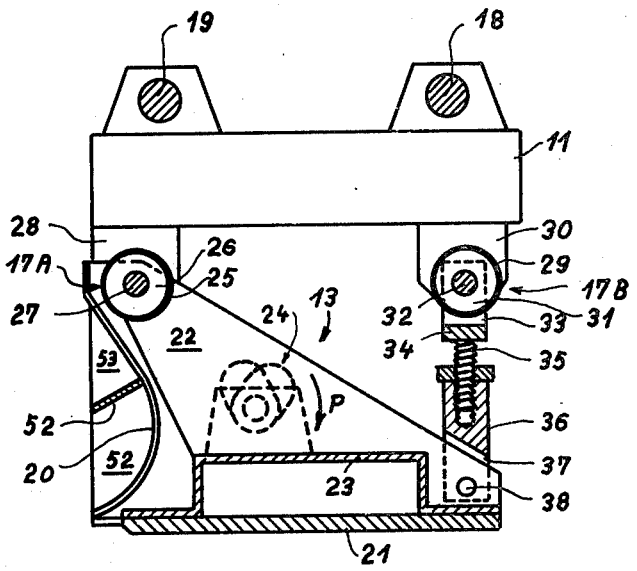
Figure 4:
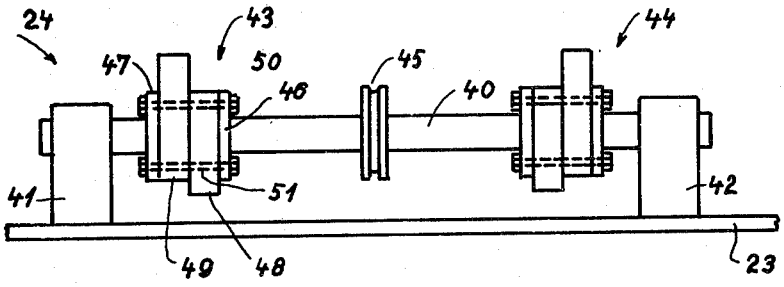

The invention will be explained more fully in the following description of an embodiment with reference to the drawing, in which FIG. 1 is a side view of an asphalt laying machine, FIG. 2 is a rear, schematic view of the rear body of the asphalt machine, FIG. 3 is a section along the line III—III in FIG. 2, of an embodiment of the machine according to the invention, and FIG. 4 shows preferred vibration generating means.

FIG. 1 shows schematically a known asphalt laying machine comprising a vehicle 1 with a driving machine preferably adapted to drive the asphalt laying machine forwards in the direction of the arrow K and to generate a hydraulic pressure to control the movable parts, which will be described later. The machine is steered from an operator's seat 2 and has on its forward portion a platform for receiving asphalt material 3 which by means of a conveyor belt in the machine is passed down to a worm 4 for distribution of asphalt material before a screed assembly 5 over the entire width thereof, said screed assembly compacting and smoothing the asphalt material to a finished asphalt course. At both sides of the machine the screed assembly 5 is secured to an arm 6 whose free end is rotatably mounted on the base frame of the machine so that the height of the screed assembly 5 may be adjusted by means of a hydraulic cylinder 7 associated with each arm. In the embodiment shown the screed assembly 5 is symmetric around the central plane M (FIG. 2) of the machine in the direction of travel and comprises on either side of said center line a so-called main screed 8 and a side screed 9, which may be moved for example hydraulically laterally of the side boundary of the main screed plate 8 for increasing the width of the asphalt course laid.

FIG. 2 shows to the left of the central plane M of the machine a main and screed 8 and 9 respectively seen from behind, said side screed 9 being moved somewhat to the left. The main screed 8 is carried by a rigid frame 10 secured to the arm 6 extending rearwardly in relation to the screed 8 with the purpose of guiding and carrying a rigid frame 11 for the side screed 9 so as to make this movable in parallel with the main screed 8 immediately behind it. This is achieved by the attachment to the ends of the frame 11 of one or more smooth shafts 18 adapted to slide in associated bushings at the end of the arm 6. Hydraulic means (not shown) may be used for moving the frame 11 to a desired position which is staggered with respect to the frame 10 between an outer position, where the asphalt course laid has a maximum width in relation to the central plane M, and an inner position, where the width of the asphalt course is determined by the main screed. The frames 10 and 11 as well as the corresponding frames to the right of the central plane M are in any case rigidly interconnected, and according to the invention the smoothing and compacting unit of the machine is divided into a plurality of sections, in the shown embodiment so that each frame has associated therewith a separate smoothing and compacting section 12, 13 connected to the associated frame 10 and 11 respectively via a plurality of vibration dampers. FIG. 2 shows two vibration dampers 14 and 16 for the section of the main screed and two vibration dampers 15 and 17 for the section of the side screed. Each section has separate, vibration generating means, and the vibration dampers are employed for preventing the vibrations of the individual sections from interacting and propagating to the other part of the machine via the arms 6. The sections are of such a size as to give rise to no nodes therein, so that the asphalt material is affected uniformly by the smooth under side of the whole section. As the vibrations cannot progate to the other part of the machine the wear on said machine is reduced.

FIG. 3 shows a section taken along the line III—III in FIG. 2 of a vibration damper comprising a front vibration damper 17A and a rear vibration damper 17B. FIG. 3 might just as well show a corresponding section of an arbitrary one of the sections as far as the smoothing and compacting section 13 is concerned, while the overhead frame 11 belongs to one of the lateral extension sections, there being shown two smooth shafts 18, 19 carrying the section 13 and being adapted to slide in bushings which are firmly mounted with respect to the frame 10 shown in FIG. 2. The bushings will thus preferably not extend beyond the main screed 8 so that the length of the shafts 18, 19 exceeds that of the frame 11 by a distance corresponding to the length of the bushings.

A smoothing and compacting section like the one shown in FIG. 3 has on the forward portion thereof a concave scraper plate 20 and a smooth smoothing and compacting plate i.e. a screed plate 21 in the bottom. The scraper plate 20 and the base plate 21 are braced by means of plates of which the plate 22 is shown, and a longitudinal profile 23 carrying a vibration generating means 24 comprising rotary, eccentric weights which turn in the direction indicated by the arrow P, whereby a vibrating movement is imparted to the section 13 in a vertical as well as a horizontal direction in FIG. 3.

According to the invention the section 13 is mounted in a vibration damping manner in relation to the frame 11, which is achieved by means of vibration dampers, where all vibration dampers at the front edge are formed like the vibration damper 17A shown in FIG. 3, while all the rear vibration dampers are formed like the shown vibration damper 17B. The vibration damper 17A comprises a bushing 25 which is attached to the bracing plate 22 and is provided an elastic sleeve 26 with a bore for a shaft 27 secured at either end to a pair of flanges, of which the flange 28 is shown, on the frame 11. The vibration damper 17B comprises likewise a bushing 29 secured to a flange 30 on the frame 11. Within the bushing 29 there is provided an elastic sleeve 31 with a bore for a shaft 32 whose ends are mounted in the prongs of a fork 34, of which the prong 33 is shown. The fork 34 has a threaded, rotatable pin 35 for cooperating with an internal thread in one end of a clamp 36, whose other end is formed as a fork whose prongs, of which the prong 37 is shown, extend on their respective sides of the support plate 22 and are rotatably attached thereto by means of a shaft 38. The section 13 is thus swingably suspended as far as horizontal movements in FIG. 3 are concerned.

According to the invention the sleeve 26 is made of a more elastic material than that of the sleeve 31, permitting a greater vibration amplitude at the front edge of section 13 than at the rear edge of section 13. As the vibration damper 17B is swingably mounted as far as horizontal movements in FIG. 3 are concerned, only the rigid section 13 is damped in respect of horizontal vibrations by means of the vibration damper 17A, while the vibration damper for vertical movements permits a larger vertical amplitude at the front edge of section 13 than at its rear edge. This is an advantage since the asphalt material is looser at the front edge of section 13 than at the rear edge, and a correct adjustment of the total length of the fork 35 and the clamp 36 gives an optimum, even compaction to the asphalt material. The horizontal vibration movement of the screed plate 21 provides for a smoothing of the asphalt course, leading to a very smooth surface thereof.

In connection with FIG. 4 the vibration generating means 24 will be described in greater detail. These means comprise a shaft 40 extending over the greater part of the length of an associated smoothing and compacting section and is rotatably mounted in relation to said section by means of blocks 41, 42 secured to the profile plate 23, which is also shown in FIG. 3. The shaft 40 is rotated via a V-belt pulley 45 and a not shown motor and has near the blocks 41, 42 uniformly formed, eccentric devices 43, 44. Each of these devices comprises a flange 46 attached to the shaft 40 and a corresponding flange 47. Between said two flanges there are positioned two uniform discs 48, 49 with associated bores for the shaft 40, said bores being disposed eccentrically with respect to the center of gravity of each disc. Each disc 48, 49 has a plurality of through bores for receiving bolts 50, 51 extending through the flanges 47, 48 so that the eccentric discs 48, 49 may be clamped between the flanges 46 and 47 with a desired, mutual angular motion predetermined by the positioning of the through bores in the discs 48, 49. The effective eccentricity of the devices 43, 44 may thus be varied, for example in dependency on the properties of the asphalt material employed by removing the bolts 50, 51 and turning the discs 48, 49 with respect to each other until a new set of holes in the discs are flush with the holes in the flanges 46, 47. Then the discs 48, 49 are clamped together again by means of the bolts 50, 51.

When the shaft rotates in the direction of the arrow P in FIG. 3 the whole section 13 will perform a vibrating, rotating movement whose amplitude is determined by the eccentricity of the devices 43, 44 and by the effect of the vibration dampers. As mentioned above, the vibration movement at the front edge of the section 13 is not the same as that at the rear edge of the section, the front edge of the section 13 performing vertical movements whose amplitude is greater than the vertical movements at the rear edge. This advantageous distribution of the vertical mode of movement is further enhanced in that the shaft 40 is positioned so that its distance to the vibration damper 17a is shorter than the distance to the vibration damper 17B.

The described vibration movement which is obtained by the machine according to the invention may be utilized to improve further the uniformity of the asphalt course because the mode of movement of the front edge of the section 13 in connection with the concave configuration of the scraper plate 20 entails that the asphalt material is not only conveyed to the outer surface of the section, but is also inverted so that it is not the same material that accumulates before the scraper plate 20 where it may get cold. Said constant inversion of the asphalt material means that the material compacted under the screed plate 21 will have a uniform temperature, imparting a more uniform surface to the finished asphalt course. The transport of asphalt material in front of the scraper plate 20 may be further improved by providing the scraper plate with a plurality of inclined guide plates of which two guide plates 52 and 53 are shown in FIG. 3. It appears from FIG. 3 that the guide plates extend from a point at the bottom of the scraper plate 20 and from there in an inclined upward direction and away from the central line M (FIG. 2). Hereby the asphalt material is conveyed so effectively towards the outer sides of the extension sections so as to obviate the necessity of extending the worm conveyor 4 shown in FIG. 1 beyond the width of the machine 1.

In addition to the many described advantages, which are obtained by the machine according to the invention, it also provides for a better working environment for the operators, the vibration damping reducing the level of noise. For the operator who stands on a footboard on the screed assembly 5 itself in order to control the quality of the asphalt course it is a clear advantage that the footboard does not vibrate vigorously as is the case in the prior art machines.

I claim:

1. An asphalt laying machine with a compacting unit comprising a main section with vibration generating means, and comprising one or more additional sections for variably expanding the working range of the compacting unit, wherein the main section is suspended in vibration isolated manner from a main carrier and each additional section comprises respective vibration generating means and is suspended in a vibration isolated manner from a respective carrier frame, the carrier frame being slidably mounted on the main carrier, and wherein the said sections are connected to the respective carrier means exclusively by vibration dampers comprising vibration dampers on the forward portion of each section, seen in relation to the asphalt laying direction of the machine, the forward vibration dampers being arranged to damp both horizontal and vertical vibration of the associated section and comprising at the rear portion of the section vibration dampers permitting substantially undamped horizontal movements in the longitudinal direction of the machine, but damping vertical vibration of the associated section.

2. A machine according to claim 1, and comprising a scraper plate for asphalt material at the front edge of the compacting unit, wherein the scraper plate is divided into sections, each of which being secured to an associated compacting sector for vibration therewith.

3. A machine according to claim 2, wherein the scraper plates are concave, and wherein the vibratory movements are directed so as to move each section forward in the direction of travel of the machine when the section is near its lowermost position.

4. A machine according to claim 3, wherein the scraper plates have a plurality of inclined guide plates sloping away from the front edge of the associated section and towards the nearest outer side of the machine.

* * * * *